United States Patent [19]

Kamilos

[11] Patent Number: 4,869,320

[45] Date of Patent: Sep. 26, 1989

[54] WELLBORE PACKER

[75] Inventor: G. N. Kamilos, Dublin, Calif.

[73] Assignee: Chevron Research Company, San Francisco, Calif.

[21] Appl. No.: 794,344

[22] Filed: Oct. 31, 1985

[51] Int. Cl.[4] ..... E21B 33/126

[52] U.S. Cl. ..... 166/202; 166/303

[58] Field of Search ..... 166/202, 179, 192, 135

[56] References Cited

U.S. PATENT DOCUMENTS

| | | | |
|---|---|---|---|
| 2,305,282 | 12/1942 | Taylor, Jr. et al. | 166/202 X |
| 2,723,721 | 11/1955 | Corsette | 166/202 X |
| 3,010,518 | 11/1961 | Harmon | 166/202 X |
| 4,484,626 | 11/1984 | Kerfoot et al. | 166/191 |

*Primary Examiner*—Stephen J. Novosad

*Attorney, Agent, or Firm*—E. J. Keeling; A. S. Zavell; E. A. Schaal

[57] ABSTRACT

A wellbore packer capable of sealing a tubing string within a wellbore casing or wellbore is described.

9 Claims, 1 Drawing Sheet

WELLBORE PACKER

FIELD OF THE INVENTION

The invention relates to wellbore packers. More specifically, this invention relates to a welbore packer for use in a steam injection well.

BACKGROUND OF THE INVENTION

A well usually consists of a casing cemented to the formation and one or more injection or production tubes within the casing. Occasionally, an open bore hole, i.e., one without a casing, contains the injection or production tubing strings therein. The well may often penetrate numerous production or injection zones of interest. These production or injection zones must be isolated from each other and from the casing as a whole so that hydrocarbons or injected fluids and gases can be placed in a particular zone of interest. The zones of interest are isolated by what is known in the industry as packers.

Packers normally are placed above and below the zone of interest and seal the production and/or injection tubing within the casing or wellbore. Packers can either be permanent or retrievable depending upon the operation.

Many parts of the Unites States and other areas of the world have hydrocarbons which are too heavy to be produced and flow on their own without assistance. To assist the movement of the hydrocarbons, steam, non-condensible gas or other injectible fluids and gas combinations are often injected into the formation to assist the movement of hydrocarbons. In areas where there are multiple production zones and each zone requires a different steam quality and/or injectible fluid, these zones must be isolated by packers so that the correct steam quality and/or injectible fluid or gas can be injected into the specific zone of interest. For example, two adjacent producing zones may require a steam quality of 80% in the first zone but only a steam quality of 50% in the second zone or both zones may require the same quality steam but they are separated by a fixed non-producing zone which must be packed off to avoid wasting the injected steam.

Steam injection with its high temperatures presents additional problems. In addition, the movement of the tubing string within the wellbore may damage the packer. Also, the packer may not be able to hold pressure within the packed off zone immediately after placement because it may not have adequately engaged the sides of the tubing string or wellbore.

Thus, it would be highly desirable to have a packer suitable for use in high-temperature environments which are not damaged by movement of the tubing string within the wellbore or casing. It is also desirable to have a packer firmly engage the wellbore or casing after insertion therein.

BRIEF DESCRIPTION OF THE INVENTION

I have invented a packer particularly suitable for use in high-temperature operations, such as steam.

Steam injection with its high temperatures presents additional problems. The packer may deform due to the temperature of the steam. In addition, the movement of the tubing string within the wellbore may damage the packer. Also, the packer may not be able to hold pressure within the packed off zone immediately after placement because it may not have adequately engaged the sides of the tubing string or wellbore.

Thus, it would be highly desirable to have a packer suitable for use in high-temperature environments which are not damaged by movement of the tubing string within the wellbore or casing. It is also desirable to have a packer firmly engage the wellbore or casing after insertion therein.

BRIEF DESCRIPTION OF THE INVENTION

I have invented a packer particularly suitable for use in high-temperature operations, such as steam injection operations, which has the previously recited desirable attributes and other benefits which are readily apparent to the ordinary skilled artisan. The packer is shaped to energize, i.e., seal the tubing string within the wellbore or casing, is constructed of materials which resist deformation when exposed to high temperatures, steam or other materials and is configured to avoid damage thereto if the tubing string moves within the wellbore or casing.

DETAILED DESCRIPTION OF THE INVENTION

The invention will be more clearly illustrated by referring to the Figures. The Figures will be described with respect to steam injection operations. However, it should be understood that the packer is suitable for use in any environment which requires the sealing of a tubing string within a casing and/or wellbore.

Figure 1:
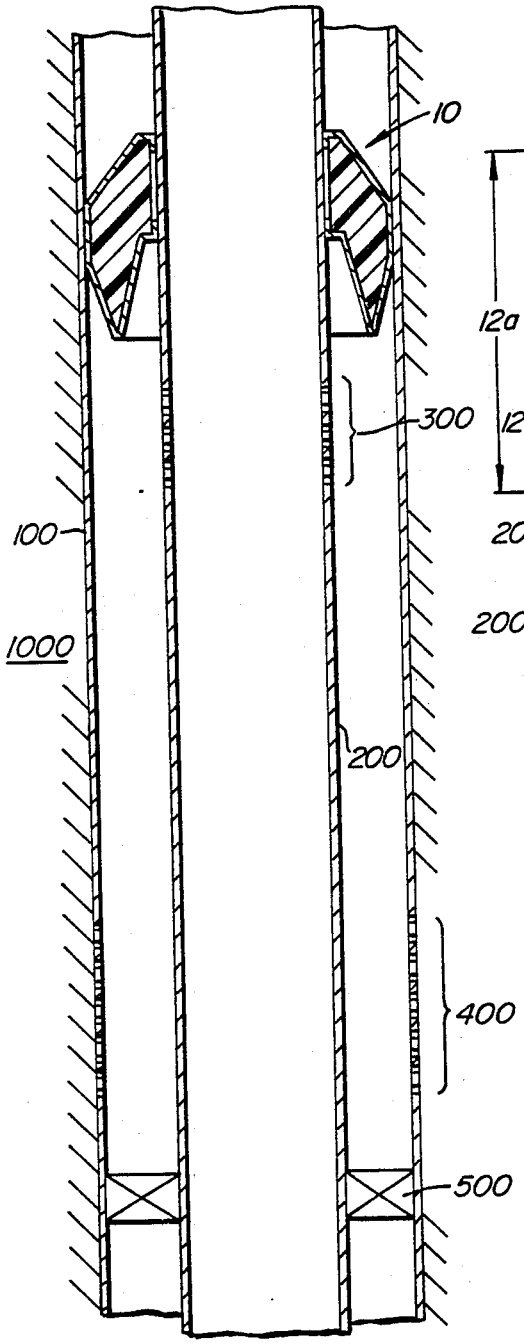
FIG. 1 illustrates a cross-sectional view of the invention within a wellbore environment.

FIG. 1 is a cross-sectional view of the packer 10 of the invention within a steam injection well. The formation 1000 contains a casing 100. Within the casing 100 is the injection tubing 200. For ease of installation, the section of the production tubing 200 will be about two to four feet long and has flanges to hold the packer 10 in place while it is inserted into the well and before it is energized. Those short sections of tubing are sometimes referred to as "short pups".

The injection tubing 200 is in communication with the casing 100 through the perforations 300. Alternatively, the perforations 300 can be chokes or critical flow valves as described in U.S. Application Serial No. 716,292, filed Mar. 26, 1985, now U.S. Pat. No. 4,640,355, incorporated herein by reference or U.S. Pat. No. 4,248,302, also incorporated herein by reference.

Steam is injected into the tubing string 200 at the surface and enters the space between the casing 100 and the tubing 200 through the perforations 300. Thereafter, the steam enters the formation through the perforations 400 in the casing 100. for maximizing the amount of steam flowing through the perforations 300 and out into the formation 1000 the through perforations 400, the tubing string 200 is packed off within the casing 100 above and below the perforations 300 and 400 by packers 500 and the packer 10 of the invention. Optionally, the packer 500 could also be packer 10 of the invention.

Figure 2:
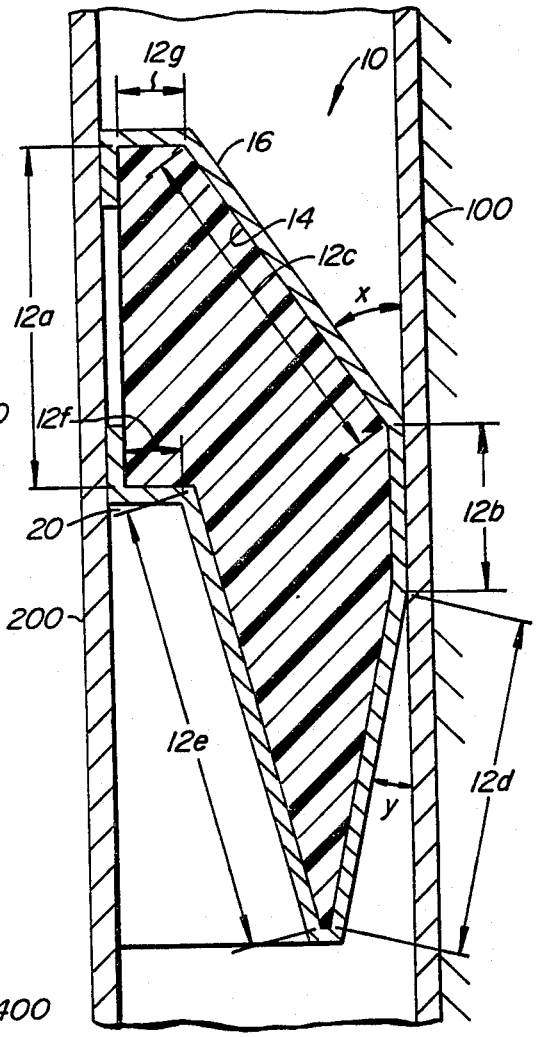
FIG. 2 illustrates a cross-sectional blow-up view of a portion of the packer illustrated in FIG. 1.
Figure 3:
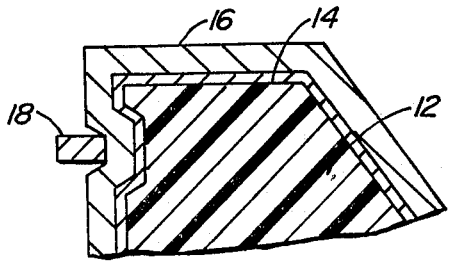
FIG. 3 illustrates a blow-upof a portion of the packer illustrated in FIG. 2.

The packer 10 is more clearly illustrated by referring to FIGS. 2 and 3. It should be clear that since cross-sectional views of the packer 10 are provided in FIGS. 1, 2 and 3, the packer 10 has a donut or washer-shaped configuration with a substantial central opening for the tubing string 200 and peripheral edges which abut the casing 100. The packer 10 could have space therein for two or more tubing strings to pass therethrough.

More specifically, the packer 10 includes a body 12 of high-temperature stable material. An example of a suitable material would be an elastomer able to sustain temperatures in excess of 300° F. and preferably in excess of 500° F. without substantially degrading and pressures of greater than 500 psi and preferably greater than 650 psi. It is also preferable that the material should be inert to solvents, acids and alkalis. A suitable material is polytetrafluoroethylene (PFTE).

The body 12 should be shaped to have a side **12*a* abutting and sealing with the production tubing 200. Spaced therefrom is a second side 12b capable of sealing with the casing 100. Between the sides 12*a* and 12*b*, is an angled side 12*c*. Side 12*c* angles away the casing 100 such that a perpendicular from the casing 100 to side 12*c* does not pass through the body 12. The angle of side 12*c* is sufficient to reduce the damage to the cup when it moves toward the surface within the wellbore. Generally, an angle of from about 30° to about 70° is sufficient. Preferably, the angle x is between 55° and 65°. The exact angle of the side 12*c* is a function of the expected movement of the body 12 within the casing 100**.

Below the sealing side **12*b* of the body 12, the body 12 has a side 12*d* which angles away from the casing 100 such that a perpendicular from the casing 100 to side 12*d* does not pass through the body 12. The angle of side 12*d* on the body 12 reduces the damage to the body 12 when the packer 10 moves down the wellbore. Preferably, the angle on portion 12 is small enough so that upon pressurization of the body 12, side 12*d* is pushed out against casing 100 to provide an additional sealing of the packer 10 to the casing 100**. A suitable angle y is from about 2 to about 30° and preferably from about 10° to 25°.

A fifth side 12e of the body 12 angles back toward the sealing side **12*a*. This angled side 12*e* helps to energize the packer 10 when steam pushes thereon. Of course, the angles of sides 12*d* and 12*e* is a function of the expected movement of the body 12 and the amount of pressure required to energize the packer 10**.

Optionally, sides **12*f* and 12*g* are added to the body 12 in the preferred illustrated embodiment to strengthen the sealing of side 12*a*** at its edges.

Substantially surrounding the body 12 is a restraining means such as stainless steel wire mesh or other suitable material which is adhered to the body 12 through a suitable securing means such as epoxy 14. The wire or stainless steel mesh 16 helps to maintain the configuration of the packer body 12 during and after the steaming operation. In addition, upon the injection of high-temperature steam, the body 12 becomes fluid and flows through the mesh 16, i.e., the visco-elastic modulus decreases allowing the body material to eneregize, to form a seal with the injection tubing 200 and the casing 100.

The pressure of the steel restraining means 16 on the body 12 allows the packer 10 to be easily inserted into the wellbore. Upon heating, the body 12 extrudes therethrough to the casing and tubing surfaces to form a seal therewith. As a further sealing means, the portion of the body 12 in contact with the tubing string 200 is further sealed by a suitable sealing means 18 such as a round steel spring clip, such as a spring loaded O-ring clip. clip 18 also secures the mesh 16 to the body 12. Optionally, restraining means 16 can completely encase the body 12.

Although only one packer 10 is illustrated in FIG. 1 and described herein, the number and overall dimensions of packers will be a function of the pressure and temperature of the steam or other material to be injected into the formation. In general operations, two packers 10 would be used to form a seal above the perforations 300 and two additional packers 10 would seal the tubing 200 and the casing 100 below the perforations 400.

The invention has been described with respect to particularly preferred embodiments, modifications which would be obvious to one of ordinary skill in the art are contemplated to be within the scope of the invention.

What is claimed is:

1. A wellbore tubing and casing packer comprising:

a body of material capable of sealing a tubing string within a wellbore or casing, said body having a cross-sectional perimeter with at least five sides between a tubing string substantially parallel to a wellbore or casing wherein a first side of said body is capable of forming a seal to said tubing string and a second side disposed therefrom is capable of forming a seal to said casing or said wellbore, said body cross section further includes a third side that connects said first and second sides at an angle which is less than 90° with respect to the casing wherein a perpendicular drawn between said wellbore or casing and said third side does not pass through said body, a fourth side of said body opposite to where said third side meets said second side, said fourth side angles away from said wellbore or casing and toward said tubing string, wherein the perpendicular drawn from said wellbore or casing does not pass through said body, and a fifth side connecting said fourth side to said first side opposite to where said third side meets said first side; and retaining means for retaining the integrity of said body, said retaining means comprising a mesh that substantially surrounds said body to maintain the integrity of said body during and after exposure to an injected material.

2. The apparatus according to claim 1 wherein the angle between said third side and said casing or wellbore is between about 30° and about 70°.

3. The apparatus according to claim 2 wherein the angle between said fourth side and said casing or wellbore is between about 2° and about 30°.

4. The apparatus according to claim 3 further including additional sealing means between said first side of said body and said tubing string.

5. The apparatus according to claim 4 further including a securing means for securing the retaining means to said body.

6. The apparatus according to claim 5 wherein the body is fabricated from a high-temperature stable material.

7. The apparatus according to claim 6 wherein said body is fabricated from polytetraethylenefluoride, said securing means is epoxy, and said retaining means is a stainless steel 300 or 400 series wire mesh, and said additional sealing means is a spring loaded O-ring.

8. The apparatus according to claim 7 wherein said body further includes sixth and seventh sides at substantially right angles to said first side, said sixth side connects said first side to said third side and said seventh side connects said first side to said fifth side.

9. The apparatus according to claim 3 wherein said body further includes sixth and seventh sides at substantially right angles to said first side, said sixth side connects said first side to said third side and said seventh side connects said first side to said fifth side.

* * * * *